US005412354A

United States Patent [19]

Quan

[11] Patent Number: 5,412,354

[45] Date of Patent: May 2, 1995

[54] SINGLE LAYER DOUBLE RING HYBRID MAGIC-TEE

[75] Inventor: Clifton Quan, Arcadia, Calif.

[73] Assignee: Hughes Aircraft Company, Los Angeles, Calif.

[21] Appl. No.: 252,709

[22] Filed: Jun. 2, 1994

[51] Int. Cl.[6] ..... H01P 5/16

[52] U.S. Cl. ..... 333/121; 333/120

[58] Field of Search ..... 333/117, 120, 121, 123, 333/127, 128

[56] References Cited

U.S. PATENT DOCUMENTS

| | | | |
|---|---|---|---|
| 4,034,316 | 7/1977 | Bex | 333/120 |
| 4,636,755 | 1/1987 | Gibbs | 333/120 X |
| 4,749,969 | 6/1988 | Boire et al. | 333/121 X |
| 4,952,895 | 8/1990 | Quan | 333/121 |

FOREIGN PATENT DOCUMENTS

| | | | |
|---|---|---|---|
| 1529776 | 10/1978 | United Kingdom | 333/120 |

OTHER PUBLICATIONS

"Hybrid Ring Directional Couplers for Arbitrary Power Division," C. Y. Pon, MTT-9 Trans., No. 4, Nov. 1961.

"A Method of Analysis of Symmetrical Four-Port Networks," J. Reed and G. J. Wheeler, MTT-4 Trans., No. 4, Oct. 1956.

"Control Your Power Split Using a Hybrid 'Rat Race'," C. Y. Pon, Microwaves, Apr. 1970.

"An N-Way Hybrid Power Divider," E. J. Wilkinson, IRE Transactions on Microwave Theory and Techniques, Jan. 1960.

"An Improved Hybrid-Ring Directional Coupler for Higher Power Split Ratios," Agrawal et al., Microwave Journal, Nov. 1986.

"Design and Performance of a Wideband, Multilayer Feed Network," M. D. Abouzahra, Microwave Journal, Nov. 1986.

"Broadband Design of Ring Type Microstrip Power Divider," Roy et al., Microwave and Optical Technology Letters, vol. 3, No. 4, Apr. 1990.

*Primary Examiner*—Paul Gensler

*Attorney, Agent, or Firm*—Leonard A. Alkov; Wanda K. Denson-Low

[57] ABSTRACT

A magic-tee hybrid network fabricated as a single conductor layer circuit. The network is fabricated from two ring sections, connected together to provide four magic-tee ports, i.e., sum, difference and two input/output ports. The double ring network with single layer construction provides wide bandwidth at a low fabrication cost.

12 Claims, 2 Drawing Sheets

SINGLE LAYER DOUBLE RING HYBRID MAGIC-TEE

This invention was made with Government support under Contract awarded by the Government. The Government has certain rights in this invention.

TECHNICAL FIELD OF THE INVENTION

This invention relates microwave power divider/-combiner devices, and more particularly to a single layer, 0/180 degree ring hybrid incorporating two ring sections within the circuit in order to enhance the performance.

BACKGROUND OF THE INVENTION

There are many microwave power divider/combiner devices known in the art today. One example is the single ring rat-race hybrid magic-tee. This rat-race hybrid magic-tee device has the disadvantage of a relatively narrow, 10% to 15% frequency bandwidth.

The waveguide magic-tee is characterized by its bulky size, and requires complicated machining in the fabrication of the device.

Another device is the branchline coupler with 90 degree transmission line. This device typically has a relatively narrow 5% to 12% frequency bandwidth and is sensitive to dimensional tolerance.

Another power combiner/divider device is the air-line/stripline magic-tee as described, for example, in U.S. Pat. No. 4,952,895. This device requires multi-layer construction.

Proximity couplers, e.g., the DuHammel coupler and the quadrature coupler with Schiffman's phase shifter, typically require precision front to back alignment for double sided etching of conductor patterns sensitive to material tolerances.

SUMMARY OF THE INVENTION

A single plane, double ring magic-tee circuit operable over a microwave frequency band having a nominal center frequency is described. The magic-tee includes an interconnected plurality of transmission line segments defined in a common plane, each having a nominal electrical length of one-quarter wavelength at the center frequency. The segments are interconnected to define first, second, third and fourth circuit ports on first and second rings of segments, wherein a plurality of segments are shared between the rings. The first port is defined on the first ring at a connection between first ends of first and second segments. The second and third ports are defined on the first ring equidistant from the first port, so that a microwave signal input at the first port is divided equally in phase between the second and third ports. The fourth port is defined on the second ring and spaced unequally from the second and third ports, wherein the difference in electrical lengths from the fourth port to the second port and from the fourth port to the third port is nominally $\frac{1}{2}$ wavelength at the center frequency. Thus, a microwave signal input at the fourth port is divided equally and out of phase between the second and third ports.

In a preferred embodiment, the transmission line segments are suspended substrate stripline transmission line segments, defined by a dielectric substrate having a conductive trace pattern formed thereon, and suspended between electrically conductive surfaces of first and second housing plates surfaces which define air channels in correspondence with the trace pattern.

The magic-tee circuit preferably has a nominal characteristic impedance of 50 ohms. A first plurality of the transmission line segments each have a nominal characteristic impedance of 70.7 ohms, and a second plurality of transmission line segments each have a nominal characteristic impedance of 100 ohms. The 100 ohm segments are connected to define a reactive tee network.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
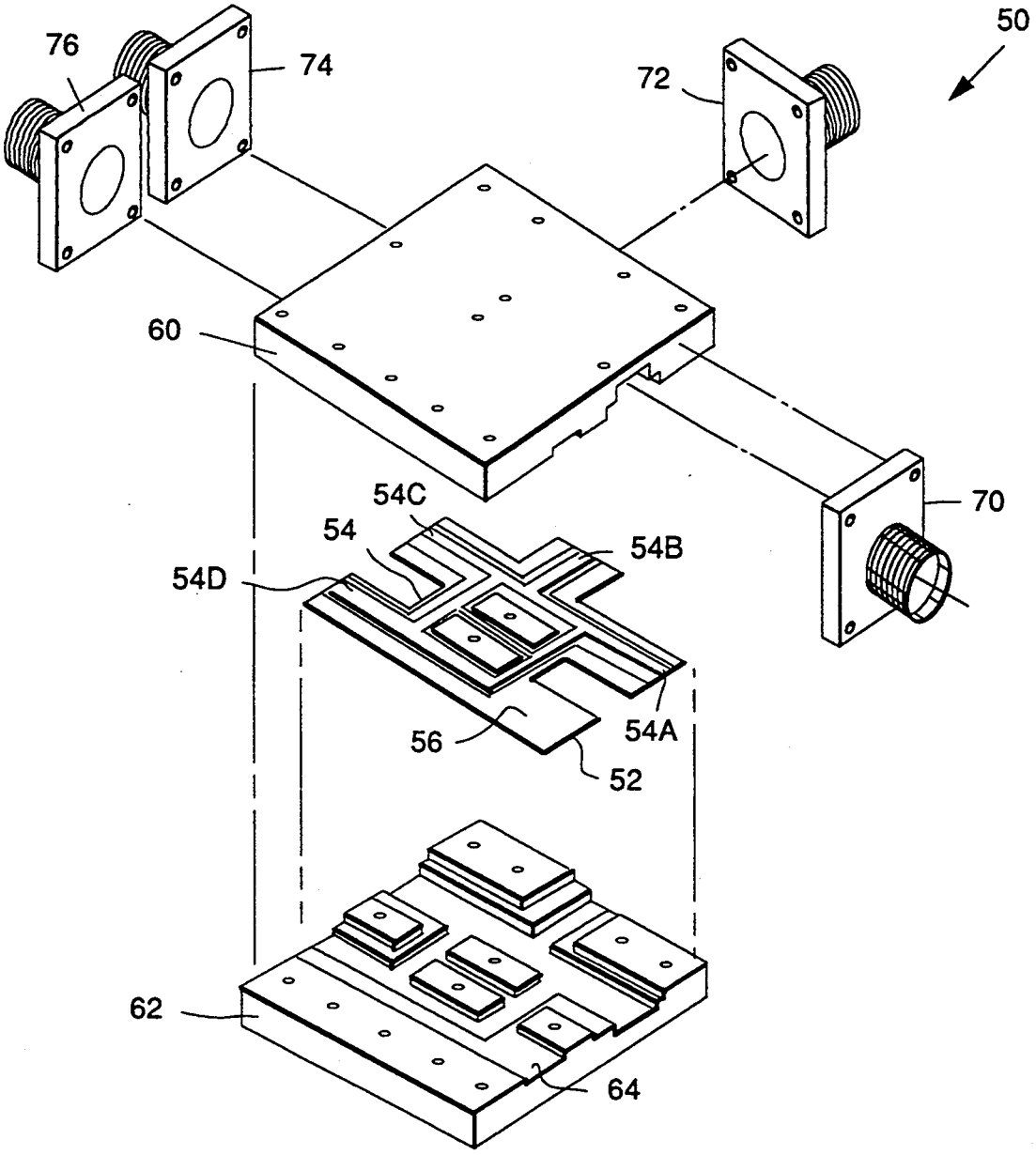
FIG. 1 is an exploded view of a double ring hybrid device in accordance with the invention.

A 0/180 degree hybrid device 50 embodying this invention is constructed using suspended substrate stripline transmission lines as shown in FIG. 1. The device 50 includes a single Teflon/fiber glass circuit board 52 with the conductor trace pattern 54 on one side 56. The circuit board 52 is then sandwiched between two metalized housing plates 60 and 62 which define air channels that follow the circuit conductor traces. For example, the bottom housing plate 62 has defined therein a channel pattern 64. Coaxial connectors 70, 72, 74 and 76 are electrically connected to the respective circuit ports 54A–54D at ends of conductor traces formed on the board 52 and to the ground planes defined by the housing plates 60 and 62 to provide four device ports.

The conductor traces comprising the trace pattern 54 represent transmission line sections in suspended substrate stripline. Each transmission line section is one-quarter wavelength long at center frequency; its associated impedance is shown in the transmission line schematic of the circuit 50 of FIG. 2. These transmission line sections form two one and one-half wavelength "rings" 80 and 82 joined by a common half wavelength section defined by one-quarter wavelength transmission line segments 90 and 92, each having a characteristic impedance of 70.7 ohms. Thus, ring 80 is defined by one-quarter wavelength transmission line segments 90, 92, 94, 96, 98 and 100, each having a characteristic impedance of 70.7 ohms. Ring 82 is defined by one-quarter wavelength transmission line segments 90, 92, 102, 104, 106 and 108. Segments 102, 104, 106 and 108 have 100 ohm characteristic impedances.

Figure 2:
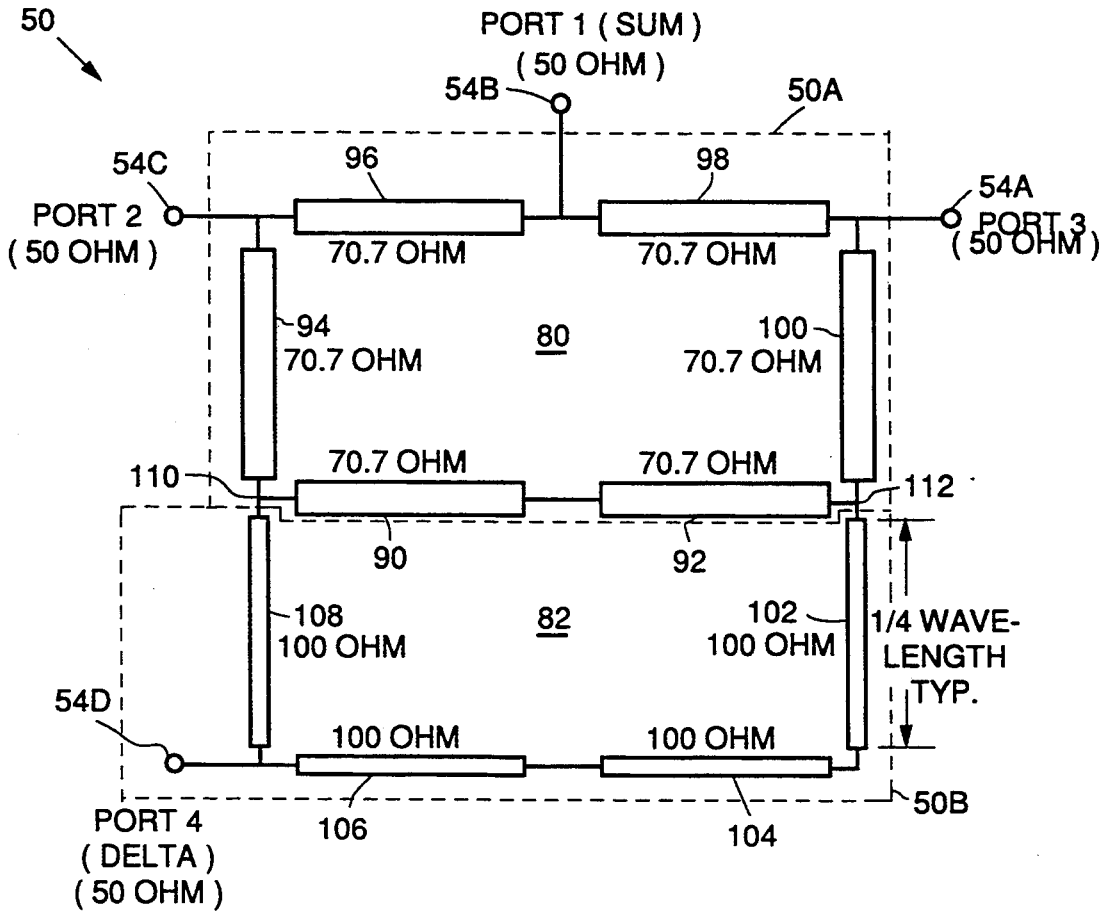
FIG. 2 is a simplified schematic diagram of the double ring hybrid device of FIG. 1.

The sum, difference, and I/O ports are connected to this double-ring construction as shown in FIG. 2. Thus, the sum port is taken at circuit port 54B, the difference port is taken at circuit port 54D, and the I/O ports are taken at circuit ports 54A and 54C. The characteristic impedance at each device port is 50 ohms.

The single ring configuration of ring 80, i.e., the single ring network indicated by broken line 50A, and omitting the segments 102, 104, 106 and 108, is per se known in the art as a 5-port power divider network, with the ports taken at nodes 110 and 112 in addition to 54A–54C. The invention is an extension of this known network configuration 50A. By applying even-odd mode analysis, as described for example in "Method of Analysis of Symmetrical Four-Port Networks" , J. Reed and G. J. Wheeler, MTT-4 Trans., No. 4, October 1956, and "Hybrid Ring Directional Couplers for Arbitrary Power Division" , MTT-9 Trans., No. 4, November 1961, the transmission line impedances required to achieve good in-phase and out-of-phase equal power splits and good isolation between ports can be determined for the single ring network configuration 50A. For convenience, ports 1, 2 and 3 (at nodes 54A–C) are chosen to have image impedances of 50 ohms while ports 4 and 5 (at nodes 110, 112) are chosen to have an image impedance of 100 ohms, e.g., the impedance looking into the particular node 110, 112 is selected to be 100 ohms. The 100 ohm image impedances are analogous to the isolation resistor termination in a Wilkinson power divider, e.g., as described in "An N-Way Hybrid Power Divider", MTT-8 Trans., January 1960. The even mode response is achieved simply by inputting a signal at input port 1 (node 54B). The odd mode response is achieved by applying two signals to the isolated ports 4 and 5 (nodes 110, 112). These two signals are equal in amplitude but 180 degrees out-of-phase from each other. To realize these two signals for the odd mode response in accordance with the invention, a simple reactive tee power splitter network 50B, whose output line lengths differ by one-half wavelength, is connected to the single ring 50A. The characteristic impedances of transmission lines 102, 104, 106 and 108 are selected to be 100 ohms. This is because the parallel combination of the outputs equals the 50 ohm image impedance at the difference port 54D. The one-quarter wavelength transmission line segments 104 and 106 add the half-wavelength line length differential to the output line length, providing the 180 degree phase difference. Combining the 5-port ring configuration 50A with the 180 degree reactive tee network 50B results in the double ring 0/180 degree hybrid ring network 50.

The invention provides RF performance across a wide frequency bandwidth (e.g., in one implementation, a 3 GHz bandwidth at X-band) with low RF losses in a single conductor layer. The fabrication of a single layer embodiment of the invention is less expensive for a given frequency performance than conventional power divider/combiner devices. Thus, the invention provides the means to fabricate lower cost TEM four-port hybrid magic-tee network devices that exhibit a 30 percent bandwidth. Such devices are useful in microwave applications such as antenna feed, monopulse and radiator circuits for active radar arrays.

While the exemplary embodiment has been described as employing suspended stripline transmission lines, the invention is not limited to this type of transmission line medium. For example, the invention could also be implemented in microstripline, "squareax" (a square center conductor surrounded by a square outer conductor), coaxial line, or in general any type of transmission line supporting TEM mode transmission.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A double ring, magic-tee network device, operating over a microwave frequency band having a center frequency, the device comprising:

a first transmission line ring having an electrical length of one and one-half wavelengths at said center frequency, said first ring defined by a first plurality of transmission line segments serially interconnected in a closed ring configuration, said first plurality of segments including first and second segments each having an electrical length of one-quarter wavelength at said center frequency, first ends of said first and second segments connected together at a first network node, second ends of said first and second segments spaced one-quarter wavelength from said first network terminal node and defining respective second and third network nodes; and a second transmission line ring having an electrical length of one and one-half wavelengths at said center frequency, said second ring comprising a second plurality of serially interconnected transmission line segments having an aggregate electrical length of one wavelength at said center frequency, opposed ends of said second plurality of segments connected at spaced fourth and fifth nodes defined on said first ring so that said first ring and said second ring share a one half wavelength length of transmission line segments, said fourth node separated by one-quarter wavelength from said second node, said fifth node separated from said third node by one-quarter wavelength, a sixth node on said second ring and separated from said fourth node by one-quarter wavelength;

wherein a signal presented at said first node is equally divided into two in-phase signals appearing respectively at said second and third nodes, and a signal presented at said sixth node is equally divided into two equally divided out-of-phase signals appearing respectively at said second and third nodes.

2. The device of claim 1 wherein all of said transmission line segments comprising said first and second rings are located on a single plane.

3. The device of claim 2 wherein said transmission line segments comprising said first and second rings are suspended substrate stripline transmission line segments.

4. The device of claim 3 further comprising a dielectric substrate having a conductive trace pattern formed thereon, said trace pattern suspended between electrically conductive surfaces of first and second housing plates which define air channels in correspondence with the trace pattern, wherein said suspended substrate stripline transmission line segments are defined by corresponding segments of said trace pattern.

5. The device of claim 4 further comprising respective stripline-to-coaxial transition devices connected at said first, second, third and sixth nodes to provide coaxial device ports.

6. The device of claim 1 wherein said device has a nominal characteristic impedance of 50 ohms, said first plurality of transmission line segments each have an electrical length equal to one-quarter wavelength at said center frequency, and a nominal characteristic impedance of 70.7 ohms, and said second plurality of transmission line segments each have an electrical length equal to one-quarter wavelength at said center frequency and a nominal characteristic impedance of 100 ohms.

7. The device of claim 1 wherein said second plurality of segments is connected to define a reactive tee network having output transmission line lengths which differ by one half wavelength at said center frequency.

8. A single plane, double ring magic-tee circuit operable over a microwave frequency band having a nominal center frequency, comprising:

an interconnected plurality of transmission line segments each having a nominal electrical length of one-quarter wavelength at said center frequency, said segments defined in a common plane;

said segments interconnected to define first, second, third and fourth circuit ports on first and second rings of segments, said first and second rings sharing a plurality of said segments;

said first port defined on said first ring at a connection between first ends of first and second segments, said second and third ports defined on said first ring equidistant from said first port, so that a microwave signal input at said first port is divided equally in phase between said second and third ports;

said fourth port defined on said second ring and spaced unequally from said second and third ports, wherein the difference in electrical lengths from said fourth port to said second port and from said fourth port to said third port is nominally ½ wavelength at said center frequency, wherein a microwave signal input at said fourth port is divided equally and out of phase between said second and third ports.

9. The circuit of claim 8 wherein said transmission line segments are suspended substrate stripline transmission line segments.

10. The circuit of claim 9 further comprising a dielectric substrate having a conductive trace pattern formed thereon, said trace pattern suspended between electrically conductive surfaces of first and second housing plates which define air channels in correspondence with the trace pattern, wherein said suspended substrate stripline transmission line segments are defined by corresponding segments of said trace pattern.

11. The circuit of claim 10 further comprising respective stripline-to-coaxial transition devices connected at said first, second, third and fourth ports to provide coaxial device ports.

12. The circuit of claim 8 wherein said circuit has a nominal characteristic impedance of 50 ohms, a first plurality of said transmission line segments each have a nominal characteristic impedance of 70.7 ohms, and a second plurality of transmission line segments each have a nominal characteristic impedance of 100 ohms.

* * * * *